US008453876B2

(12) United States Patent
Miller

(10) Patent No.: US 8,453,876 B2
(45) Date of Patent: Jun. 4, 2013

(54) COLORANT RECIRCULATION AND DISPENSE VALVE

(75) Inventor: William A. Miller, Buffalo Grove, IL (US)

(73) Assignee: Fluid Management Operations LLC, Wheeling, IL (US)

( * ) Notice: Subject to any disclaimer, the term of this patent is extended or adjusted under 35 U.S.C. 154(b) by 410 days.

(21) Appl. No.: 12/632,482

(22) Filed: Dec. 7, 2009

(65) Prior Publication Data

US 2011/0132923 A1 Jun. 9, 2011

(51) Int. Cl.
*B67B 7/00* (2006.01)
*B67D 7/06* (2010.01)

(52) U.S. Cl.
USPC ..... 222/1; 222/318; 222/135; 222/144; 222/504

(58) Field of Classification Search
USPC ..... 222/132, 135, 144, 252, 318, 322, 222/380, 501, 504; 118/312, 602; 137/625.2, 137/625.25, 625.67, 625.48, 565.35; 239/124, 239/125
See application file for complete search history.

(56) References Cited

U.S. PATENT DOCUMENTS

| | | | | |
|---|---|---|---|---|
| 3,122,272 | A * | 2/1964 | Marsh | 222/26 |
| 3,463,363 | A * | 8/1969 | Zelna | 222/334 |
| 6,089,413 | A * | 7/2000 | Riney et al. | 222/318 |
| 7,028,867 | B2 * | 4/2006 | Acum et al. | 222/504 |
| 2003/0155384 | A1 * | 8/2003 | Nagahata et al. | 222/504 |
| 2005/0017024 | A1 * | 1/2005 | Miller | 222/185.1 |
| 2005/0230438 | A1 * | 10/2005 | Saidman | 222/504 |

* cited by examiner

*Primary Examiner* — Kevin P Shaver
*Assistant Examiner* — Patrick M Buechner
(74) *Attorney, Agent, or Firm* — Miller, Matthias & Hull LLP

(57) ABSTRACT

A combination dispense and recirculation valve assembly is disclosed for viscous fluids. The assembly easily moves between a dispense and a recirculation position. Therefore, a pump linked to the canister of fluid being dispensed can be run continuously, intermittently or on demand. After the dispense, the actuator moves the valve stem downward to block any further dispense and the pump recirculates fluid upward past an upper valve element and upper valve seat into a recirculation outlet and back into the canister. In the closed position, the valve chamber is sealed to prevent air from causing any remaining colorant to dry. When a dispense is desired, the actuator simply raises the valve stem upward so the upper valve element engages the upper valve seat thereby preventing fluid from being recycled and directing all fluid downward past the lower valve element and out through the nozzle. The combination dispense and recycle valve assembly is particularly useful for multiple fluid dispensers including, but not limited to paint dispensers.

13 Claims, 3 Drawing Sheets

COLORANT RECIRCULATION AND DISPENSE VALVE

BACKGROUND

1. Technical Field

A recirculation system is disclosed for paint colorants used in automated paint dispensing and paint formulation machines. The recirculation system prevents the settling out of heavier materials such as pigments of a colorant (i.e., tint) slurry or formulation. The recirculation system provides recirculation up to the nozzle outlet.

2. Description of the Related Art

Systems for dispensing a plurality of different fluids into a container are known. For example, systems for dispensing paint base materials and colorants into a paint container are known. These paint systems may use twenty or more different colorants to formulate a paint mixture. Each colorant is contained in a separate canister or package and may include its own dispense pump. The colorants and their respective pumps may be disposed on a turntable or along one or more stationary horizontal rows. In a turntable system, the turntable is rotated so that the colorant to be dispensed is moved to a position above the container being filled. In designs using one or more horizontal rows, the container may be moved laterally to the appropriate colorant/pump or the colorants may be dispensed through a manifold.

In paint dispensing applications, precision is essential as the color formulations or paint formulations require the addition of precise amounts of tints or colorants. One way in which the precision of a paint dispensing systems is compromised when the condition of a colorant or tint becomes non-uniform as a result of a settling out of heavier components of the colorant slurry during storage in the canister prior to dispensing or between dispenses.

Specifically, the actual pigments of a colorant slurry tend to be heavier than the remaining components, such as the solvent. As these heavier materials gather or collect towards the bottom of the canister under the force of gravity, the colorant slurry has non-uniform concentrations of the various ingredients from the bottom of the canister to the top of the canister. As a result, the heavier pigment materials may be dispensed in a higher concentration when the canister is relatively full and at a lower concentration when the canister is close to being empty. The non-uniformity of the colorant slurry leads to inaccuracies in the final paint formulation.

This problem is exacerbated by the reduced amounts of volatile organic compounds (VOCs) being used in some colorants and the VOC-free colorants. In short, the low-VOC and VOC-free colorant slurries have a higher tendency to separate or settle out than the VOC-based colorants, such as glycol-based colorants. While separation takes place in glycol-based colorants, the separation typically takes longer to occur.

Currently available paint dispensing machines employ agitation devices within the colorant canisters to prevent settling. The agitation devices are activated periodically by software programmed into the controller of the machine. However, colorant disposed in the sections of tubing between the canister and the pump and between the pump and the outlet, i.e., the dispense valve, manifold or nozzle, are not agitated. As a result, the colorant in the tubing, manifold, dispense valve or other areas of the system outside of the canister will separate over time and affect the accuracy of the dispense.

Further, if the dispense pumps are not used relatively frequently, low VOC, VOC-free and even glycol-based colorants may settle inside of the pump. The accumulation of the solid particles can cause many types of pumps to jam or at least operate inefficiently.

As a result, there is a need for an improved colorant canister and dispense system for use in automated paint dispensing machines that avoids the settling problem, regardless of the colorant, solvent and pump type. Further, there is a need for an improved colorant canister and dispense system for use in automated paint dispensing machines that provides recirculation in the tubing between the canister and the dispense outlet, including any dispense valves and the dispense pump. All of these components are prone to having low-VOC colorant settle within them causing clogging, uneven flow rates and requiring frequent maintenance.

SUMMARY OF THE DISCLOSURE

In satisfaction of the aforenoted needs, a dispense and recirculation valve assembly disclosed that is particularly useful for viscous slurries, such as paint tint or colorant or low-VOC paint colorants. Other applications will be apparent to those skilled in the art.

The disclosed dispense and recirculation valve assembly comprises a tube comprising a proximal end and a distal end. The distal end of the tube is connected to a nozzle. The proximal end of the tube is connected to a stem seal. The tube also includes a dispense inlet and a recirculation outlet disposed between the proximal and distal ends of the tube. The dispense and recirculation valve assembly also includes a valve stem passing through the stem seal and comprising a proximal end connected to an actuator and a distal end comprising a lower valve element. The valve stem further comprises an upper valve element disposed proximally of the lower valve element. The nozzle comprises a dispense outlet and a lower seat for receiving the lower valve element. The tube accommodates an upper valve seat disposed between the dispense inlet and the recirculation outlet for receiving the upper valve element.

In operation, to dispense material from a canister that is in communication with the dispense inlet and recirculation outlet, the actuator pulls the valve stem upward thereby releasing the lower valve element from the lower seat disposed at the nozzle. The upper valve element engages the upper seat disposed between the dispense inlet and the recirculation outlet. In this position, fluid is free to flow through the dispense inlet, down past the lower valve element and out the nozzle outlet.

To move the assembly to a recirculation mode, the actuator pushes the valve stem downward or lowers the valve stem so the lower valve element is seated at the lower valve seat at the nozzle. This blocks material from leaving the nozzle outlet. Contemporaneously, the upper valve element is released from the upper valve seat thereby establishing communication between the dispense inlet and the recirculation outlet. In other words, fluid flows in the dispense inlet, upward past the upper valve element and out the recirculation outlet and back to the canister.

The pump may be associated with either the recirculation line or the dispense line, depending upon the direction of the pump. The disclosed combination dispense and recirculation valve assemblies eliminate or substantially reduce the need for a separate canister agitation mechanism.

In a refinement, the stem seal comprises a nut comprising a top wall with an opening for receiving the valve stem. The stem seal further includes a threaded sidewall that is threadably connected to the proximal end of the tube. The stem seal further comprises a gasket trapped between the top wall of the nut and the proximal end of the tube.

In a further refinement of this concept, the stem seal assembly also comprises a sleeve through which the valve stem passes and which has a proximal end trapped between the gasket and the proximal end of the tube. This sleeve also has a distal end disposed proximal to the recirculation outlet and through which the valve stem frictionally slides.

In another refinement, the lower valve element comprises a tapered distal end. In yet another refinement, the lower valve element comprises a conical distal end. In yet another refinement, the lower valve element comprises a frusto-conical distal end.

In a refinement, the upper valve element comprises a tapered proximal end.

In another refinement, the actuator may be electrically controlled by a solenoid. In another refinement, the actuator is pneumatic. However, mechanical, hydraulic and magnetic actuators can be employed as will be apparent to those skilled in the art.

A multiple fluid dispenser is also disclosed which comprises a manifold, a plurality of fluid canisters, a plurality of dispense lines and a plurality of recirculation lines. The manifold is connected to each canister by one of the dispense lines and one of the recirculation lines. The manifold accommodates a plurality of dispense and recirculation valve assemblies. Each dispense and recirculation valve assembly comprises a tube having a proximal end and a distal end. The distal end of the tube is connected to a nozzle. The proximal end of the tube is connected to a stem seal. The tube further comprises a dispense inlet connected to one of the dispense lines and a recirculation outlet connected to one of the recirculation lines. A valve stem is also included which passes through the stem seal and comprises a proximal end connected to an actuator and a distal end comprising a lower valve element. The valve stem further comprises an upper valve element disposed proximally of the lower valve element. The nozzle comprises a dispense outlet and a lower seat for receiving the lower valve element. The tube accommodates an upper valve seat disposed between the dispense inlet and the recirculation outlet for receiving the upper valve element.

In a refinement, a single actuator is used for each dispense and recirculation valve assembly. In another refinement, separate actuators are used for each dispense and recirculation valve assembly.

In another refinement, a pump is disposed between dispense inlet and each canister. In a further refinement of this concept, the pump is a nutating pump. However, other types of pumps such as gear pumps, peristaltic piston and other types of pumps may be employed as will be apparent to those skilled in the art.

A method for dispensing a colorant is also disclosed. The method includes providing a canister of colorant in communication with a pump that is in communication with at least one of a recirculation line and a dispense line. The recirculation and dispense lines are in communication with a recirculation and dispense valve assembly. The recirculation and dispense valve assembly comprises a tube comprising a proximal end and a distal end. The distal end of the tube is connected to a nozzle and the proximal end of the tube is connected to a stem seal. The tube further comprises a dispense inlet connected to one of the dispense lines and a recirculation outlet connected to one of the recirculation lines. The dispense and recirculation valve assembly also includes a valve stem passing through the stem seal and which comprises a proximal end connected to an actuator in a distal end comprising a lower valve element. The valve stem further comprises an upper valve element disposed proximally of the lower valve element. The dispense and recirculation valve assembly also includes a nozzle comprising a dispense outlet and a lower seat for receiving the lower valve element. The tube accommodates an upper valve seat disposed between the dispense inlet and the recirculation outlet for receiving the upper valve element when the valve assembly is in the dispense position.

The disclosed method includes moving one of the valve stems to a dispense position where the upper valve element is biased against the upper valve seat and activating the dispense pump and dispensing fluid from the canister through the dispense outlet.

The method further includes moving the valve stem to a recirculation position where the lower valve element is biased against the lower valve seat and activating the dispense pump to pump fluid from the canister through the dispense inlet, up past the upper valve seat and back to the canister through the recirculation inlet.

The disclosed dispense and recirculation valve assemblies, fluid dispensers and methods of dispensing are applicable to other fluids other than paints, paint colorants or paint materials. The accuracy of the devices and methods disclosed herein render them useful in the food, pharmaceutical and other industries where accuracy of a dispense is essential.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
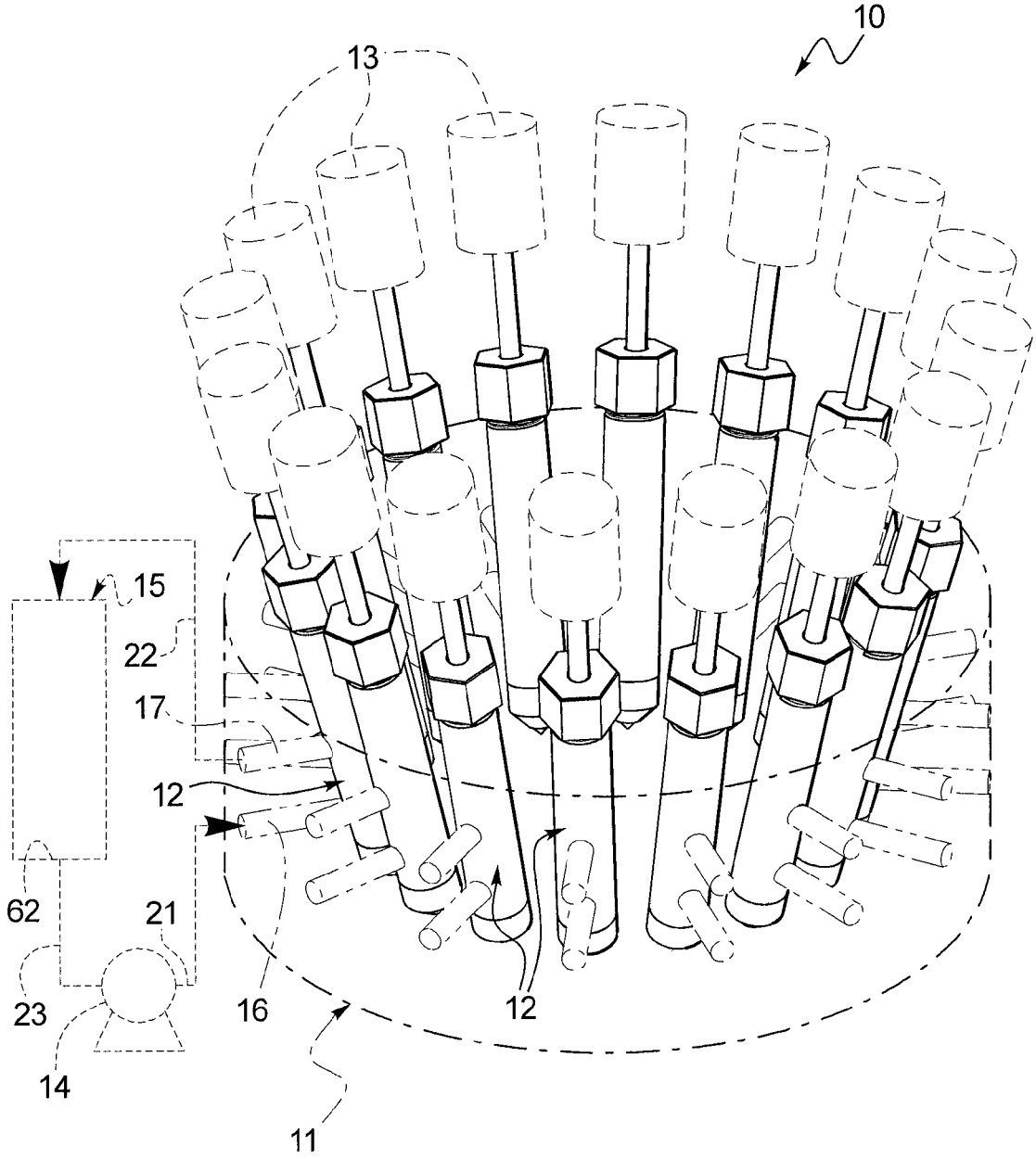
FIG. 1 is a partial perspective view of a fluid dispenser incorporating a plurality of dispense and recirculation valves made in accordance with this disclosure.

FIG. 1 illustrates, in part, a fluid dispenser 10 that includes a block manifold 11, with a plurality of dispense and recirculation valve assemblies 12. In the embodiment 10 illustrated in FIG. 1, each dispense and recirculation valve assembly 12 is equipped with its own actuator 13. However, a single actuator or a system where an actuator operates more than one dispense and recirculation valve assembly 12 may be employed, as will be apparent to those skilled in the art. For the sake of simplicity, only one of the dispense and recirculation valve assemblies 12 is linked to a pump 14 and canister 15 in FIG. 1. However, as will apparent to those skilled in the art, a separate canister would be employed for each dispense and recirculation valve assembly 12.

In the embodiment shown, the pump 14 is in communication with the dispense inlet 16 and the canister 15 is in communication with a recirculation outlet 17. Tubing may be used for the dispense line 21, the recirculation line 22, and the line 23 linking the canister 15 to the pump 14. Another variation would be to position the pump 14 in the recirculation line 22 and simply reverse the direction of the pump 14.

Figure 2:
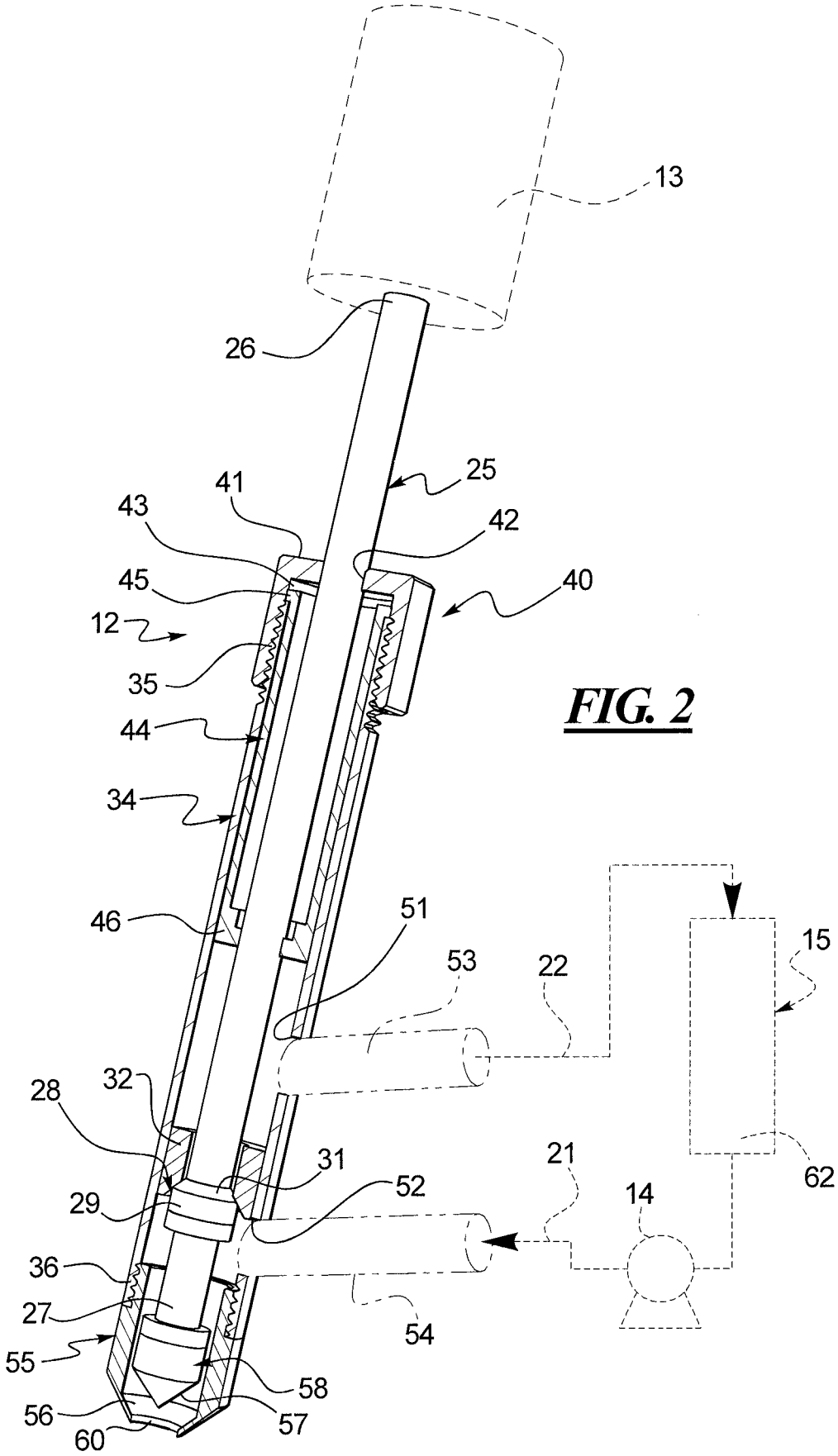
FIG. 2 is a perspective and sectional view of a disclosed dispense and recirculation valve assembly shown in a dispense position with the actuator, pump and fluid canister shown in phantom.
Figure 3:
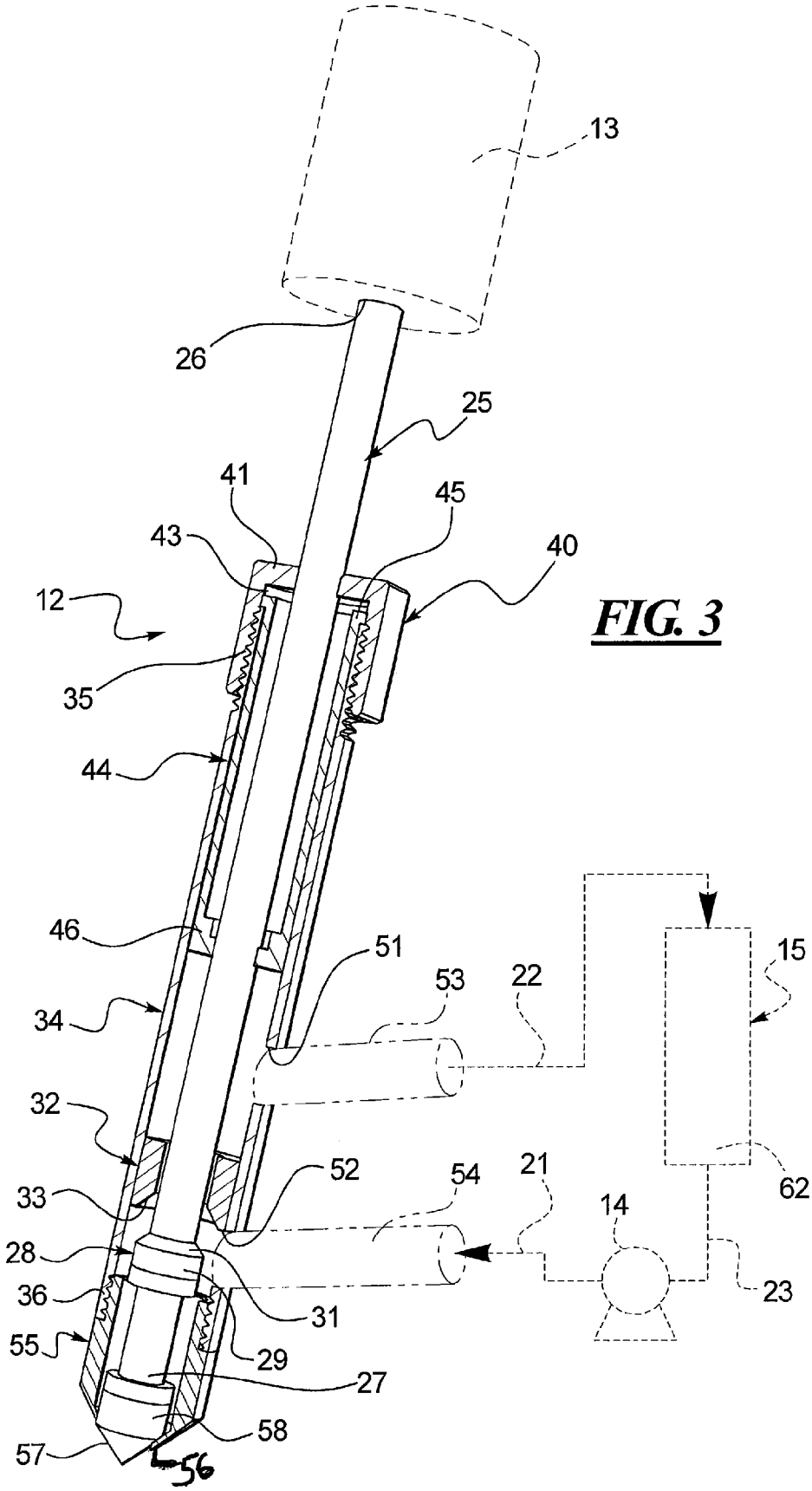
FIG. 3 is another perspective and sectional view of the dispense and recirculation valve assembly illustrated in FIG. 2 but with the valve stem lowered to a recirculation position.

Turning to FIGS. 2 and 3, the actuator 13 is connected to a valve stem 25 which includes a proximal end 26 connected to the actuator 13 and a distal end 27 connected to a lower valve member 58. Between the proximal and distal ends 26, 27 of the valve stem 25 is an upper valve element 28. The upper valve element 28 includes a cylindrical section 29 and a tapered upper section 31. As seen in the dispense position shown in FIG. 2, the tapered upper section 31 of the upper valve element 28 is seated against an upper valve seat 32 which, as shown in FIG. 3, includes a tapered lower end 33 that mates with the tapered upper section 31 of the upper valve element 28.

The dispense and recirculation valve assembly 12 also includes an outer tube 34 which includes a threaded proximal end 35 and a threaded distal end 36. The threaded proximal end 35 of the outer tube 34 is connected to stem seal assembly 40 which includes a threaded cap 41 having an opening 42 in the cap 41 for the passage of the valve stem 25. The stem seal assembly 40 may also include a gasket 43 and an inner sleeve 44. In the embodiment shown, the inner sleeve 44 includes a proximal flanged end 45 that may be trapped between the gasket 43 and the proximal end 35 of the outer tube 34. The sleeve 44 may also include a distal end 46 which also acts as a seal around the sliding valve stem 25.

In the embodiment illustrated, the outer tube 34 includes a recirculation outlet opening 51 and a dispense inlet opening 52. However, fixed stems 53, 54 may be employed which are then connected to the outer tube 34 and the recirculation and dispense lines 22, 21 respectively, or the recirculation and dispense lines 22, 21 may be connected to the openings 51, 52 of the outer tube 34 directly.

The threaded distal end 36 of the outer tube 34 is connected to a nozzle 55. While the outer tube 34 includes threaded proximal and distal ends 35, 36 respectively, other means of attachment, such as adhesives, welding, friction fit, etc. may be employed, as will be apparent to those skilled in the art. The nozzle 55 includes a lower valve seat 56. In the position illustrated in FIG. 3, lower valve seat 56 receives the tapered nose 57 of the lower valve element 58.

Thus, in the position shown in FIG. 3, the tapered nose 57 of the lower valve seat 58 is received against the lower valve seat 56 and any dispense of fluid downward through the nozzle 55 is prevented. Also, the lower valve element 58 is sealed against the lower valve seat 56 and air cannot enter the tube 34. As a result, operation of the pump causes fluid to flow through the dispense inlet 52 of the outer tube 34, upward past the upper valve element 28 which, because of the lowered position of the valve stem 25, is not engaged with the upper valve seat 32, thereby allowing fluid to flow between the valve stem 25 and the upper valve seat 32 towards and into the recirculation outlet 51. To move from the recirculation position of FIG. 3 to the dispense position of FIG. 2, the actuator 13 raises the valve stem 25 so that the tapered upper section 31 of the upper valve element 28 engages the tapered lower end 33 of the upper valve seat 32. In the position shown in FIG. 2, fluid flow from the dispense inlet 52 to the recirculation outlet 51 is prevented by the upper valve element 28 and upper valve seat 32. As the lower valve element 58 and tapered nose 57 is raised above the lower valve seat 56 of the nozzle 55, fluid proceeds through the dispense line 54, through the dispense inlet 52, downward past the lower valve element 58 and out through the nozzle outlet opening 60.

Thus, the dispense and recirculation valve assemblies 12 illustrated herein and the fluid dispenser 10 along with the methods of use thereof help reduce the problems associated with low-VOC colorant. Specifically, with low-VOC colorants, the heavier materials of the colorant slurries tend to settle towards the bottom 62 of the canister 15 between uses. One particularly problematic family of colorants are those with yellow iron oxides. Recirculation of the colorant slurries is one way of minimizing the separation of the material within the colorant slurry and maintaining homogenization. Further, the recirculation can have the beneficial effect on a thick fluid, such as shear thinning.

While only certain embodiments have been set forth, alternatives and modifications will be apparent from the above description to those skilled in the art. These and other alternatives are considered equivalents and within the spirit and scope of this disclosure and the appended claims.

What is claimed:

1. A dispense and recirculation valve assembly for a viscous slurry, the assembly comprising:

a cylindrical tube comprising a proximal end and a distal end, the distal end connected to a nozzle, the proximal end connected to a stem seal, the tube further comprising a dispense inlet and a recirculation outlet disposed between the proximal and distal ends of the cylindrical tube, a valve stem passing through the stem seal and comprising a proximal end connected to an actuator disposed outside of the tube and a distal end comprising a lower conical valve element that narrows distally and widens proximally to a diameter that is greater than a diameter of the distal end of the valve stem, the valve stem further comprising an upper frustoconical valve element disposed proximally of the lower conical valve element, the nozzle comprising a dispense outlet and a lower frustoconical valve seat for receiving the lower conical valve element, the lower frustoconical valve seat narrowing distally and widening proximally, the lower conical valve seat being threadably connected to the distal end of the tube, the tube accommodating an upper frustoconical valve seat disposed between the dispense inlet and the recirculation outlet for receiving the upper frustoconical valve element, the upper frustoconical valve element and upper frustoconical valve seat both widen distally and narrow proximally, the valve stem being movable between a recirculate position and a dispense position, in the recirculate position, the lower conical valve element engages the lower frustoconical valve seat and passes partially through the lower frustoconical valve seat and partially through the dispense outlet, in the dispense position, the lower conical valve element is moved proximally away from the dispense outlet and lower frustoconical valve seat and into the tube and the upper valve element engages the upper valve seat, wherein the stem seal comprises a nut comprising a top wall with an opening for receiving the stem, the stem seal further comprising a threaded sidewall threadably connected to the proximal end of the tube, and the seal assembly further comprising a gasket trapped between the top wall of the nut and the proximal end of the cylindrical tube.

2. The recirculation and dispense valve assembly of claim 1 wherein the stem seal assembly further comprises a sleeve through which the valve stem passes and having a proximal end trapped between the gasket and the proximal end of the tube and a distal seal end disposed proximally to the recirculation outlet and through which the valve stem frictionally slides.

3. The dispense and recirculation valve assembly of claim 1 wherein the upper valve element comprises a tapered proximal end.

4. The dispense and recirculation valve assembly of claim 1 wherein the upper valve element comprises a frusto-conical proximal end.

5. The dispense and recirculation valve assembly of claim 1 wherein the actuator is electrically controlled by a solenoid.

6. A multiple fluid dispenser comprising:

a manifold, a plurality of fluid canisters, a plurality of dispense lines, and a plurality of recirculation lines, the manifold connected to each canister by one of the dispense lines and one of the recirculation lines, the manifold accommodating a plurality of dispense and recirculation valve assemblies, each dispense and recirculation valve assembly comprising a cylindrical tube comprising a proximal end and a distal end, the distal end connected to a nozzle, the proximal end connected to a stem seal, wherein the stem seal comprises a nut comprising a top wall with an opening for receiving the stem, the stem seal further comprising a threaded sidewall threadably connected to the proximal end of the cylindrical tube, and the seal assembly further comprising a gasket trapped between the top wall of the nut and the proximal end of the tube, the cylindrical tube further comprising a dispense inlet connected to one of the dispense lines and a recirculation outlet connected to one of the recirculation lines, a valve stem passing through the stem seal and comprising a proximal end connected to an actuator disposed outside the tube and a distal end comprising a lower conical valve element that narrows distally and widens proximally to a diameter that is greater than a diameter of the distal end of the valve stem, the valve stem further comprising an upper frustoconical valve element disposed proximally of the lower conical valve element, the nozzle comprising a dispense outlet and a lower frustoconical seat for receiving the lower conical valve element, the lower conical valve seat being threadably connected to the distal end of the tube, the tube accommodating an upper frustoconical valve seat disposed between the dispense inlet and recirculation outlet for receiving the upper frustoconical valve element, the upper frustoconical valve element and upper frustoconical valve seat both widen distally and narrow proximally, the valve stem being movable between a recirculate position and a dispense position, in the recirculate position, the lower conical valve element engages the lower frustoconical valve seat and passes partially through the lower frustoconical valve seat and partially through the dispense outlet, in the dispense position, the lower conical valve element is moved proximally away from the dispense outlet and lower frustoconical valve seat and into the tube and the upper valve element engages the upper valve seat.

7. The dispenser of claim 6 wherein each upper valve element comprises a tapered proximal end.

8. The dispenser of claim 6 wherein each upper valve element comprises a frusto-conical proximal end.

9. The dispenser of claim 6 wherein each actuator is electricallly controlled by a solenoid.

10. A method for dispensing a colorant, the method comprising:

providing canister of colorant in communication with a pump in communication with at least one of a recirculation line and a dispense line, the recirculation and dispense lines in communication with a recirculation and dispense valve assembly in accordance with claim 1;

moving the valve stem to a dispense position where the upper valve element is biased against the upper valve seat and activating the dispense pump and dispensing fluid from the canister through the dispense outlet;

moving the valve stem to a recirculation position where the lower valve element is biased against the lower valve seat and activating the dispense pump to pump fluid from the canister through the dispense inlet, between the lower and upper valve elements and back to the canister through the recirculation inlet.

11. The method of claim 10 wherein the upper valve element comprises a tapered proximal end.

12. The method of claim 10 wherein the upper_valve element comprises a frusto-conical proximal end.

13. The method of claim 10 wherein the actuator is electrically controlled by a solenoid.

* * * * *